United States Patent [19]

Rose

[11] Patent Number: 4,551,587

[45] Date of Patent: Nov. 5, 1985

[54] ROTARY SWITCH FOR PRINTED CIRCUIT BOARDS

[75] Inventor: Jochen Rose, Röthenbach, Fed. Rep. of Germany

[73] Assignee: International Standard Electric Corporation, New York, N.Y.

[21] Appl. No.: 507,039

[22] Filed: Jun. 23, 1983

[30] Foreign Application Priority Data

Jul. 9, 1982 [DE] Fed. Rep. of Germany ..... 3225694

[51] Int. Cl.[4] ..... H01H 19/58

[52] U.S. Cl. ..... 200/11 R; 200/292; 200/295

[58] Field of Search ..... 200/11 A, 11 D, 11 DA, 200/11 TW, 11 J, 11 K, 292, 295, 325, 164 R, 11 R, 11 B, 11 C, 11 E, 11 EA, 11 G, 11 H, 11 TC

[56] References Cited

U.S. PATENT DOCUMENTS

| | | | |
|---|---|---|---|
| 4,107,499 | 8/1978 | Weidler | 200/292 X |
| 4,206,334 | 1/1980 | LaRock | 200/292 X |
| 4,246,453 | 1/1981 | Marchese et al. | 200/11 DA |
| 4,316,067 | 2/1982 | Whiteman, Jr. | 200/292 X |

FOREIGN PATENT DOCUMENTS

| | | | |
|---|---|---|---|
| 1043460 | 11/1958 | Fed. Rep. of Germany | 200/11 EA |

*Primary Examiner*—G. P. Tolin
*Assistant Examiner*—Morris Ginsburg
*Attorney, Agent, or Firm*—James B. Raden; William J. Michals

[57] ABSTRACT

A miniature rotary multi-position switch capable of being mounted on a printed circuit board (2). The housing (1) and the rotor (8) of the rotary switch, are each provided with a throughgoing bore (33, 16). The rotating control shaft (17) is inserted into the bore (16) of the rotor (8), so that the shaft projects on one of the sides (3, 18) of the housing (1). This permits the rotary switch to be actuated from any optional side of the printed circuit board (2). Therefore, the printed circuit board (2) can be installed with one of its two plane sides facing the actuating side of an equipment unit, and the rotary switch can be nevertheless actuated in that the control shaft (17) is fitted accordingly. The rotary switch is mounted to the printed circuit board (2) by snap locks (5) and the rotor (8) is held inside the housing (1) with the aid of detent elements (10).

11 Claims, 14 Drawing Figures

ROTARY SWITCH FOR PRINTED CIRCUIT BOARDS

BACKGROUND OF THE INVENTION

The present invention relates to a rotary switch for being mounted on a printed circuit board with the aid of extensions engaging into holes provided for in the printed circuit board.

One such type of rotary switch is known from DE-OS No. 2 362 141. According to this prior art reference, the extensions are designed as contact pins which are inserted into the printed circuit board and soldered to the conductors. The rotor is in this case arranged vertically on the printed circuit board and has a throughgoing opening for the rotating control shaft. The latter, therefore, is arranged parallel in relation to the printed circuit board. The throughgoing opening is provided because several such rotary switches are intended to be combined to form one switch assembly.

SUMMARY OF THE INVENTION

The present invention deals with the problem of mounting a rotary switch of the type mentioned hereinbefore, on a printed circuit board arranged parallel in relation to a front panel of an equipment housing, etc., and of actuating such a rotary switch, for example, from the front panel side. According to the invention, this problem is solved by the features set forth in the embodiment described in the specification. In this way the rotary switch can always be actuated from the outside and independently of whether the printed circuit board faces the actuating side of the equipment with its component side or with the opposite side.

BRIEF DESCRIPTION OF THE DRAWING

Further advantageous embodiments of the invention will now be described hereinafter with reference to an example an of embodiment shown in FIGS. 1 to 14 of the accompanying drawings, in which.

DETAILED DESCRIPTION

Figure 1:
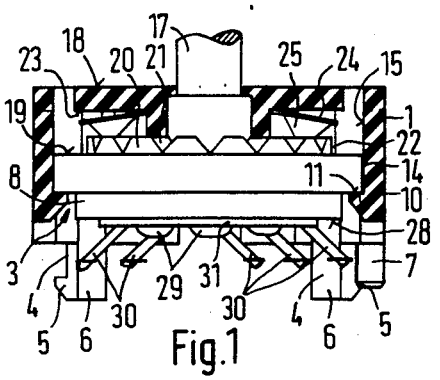
FIG. 1 shows a rotary switch according to the invention in a sectional sideview.
Figure 2:
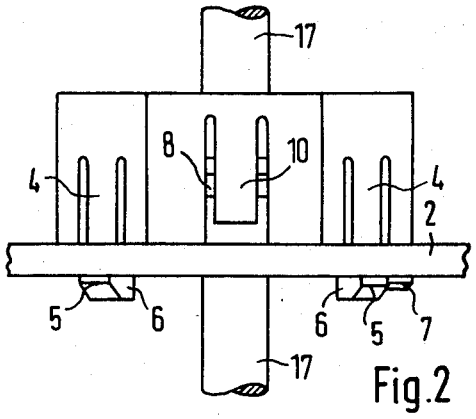
FIG. 2 shows the same rotary switch as inserted into a printed circuit board, in a sideview.
Figure 3:
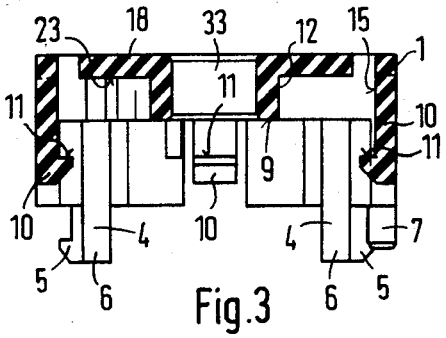
FIG. 3 shows the housing part in a sectional sideview.
Figure 4:
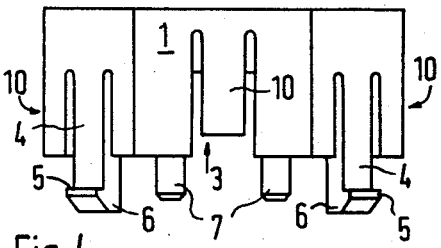
FIG. 4 shows the housing part in a sideview.
Figure 5:
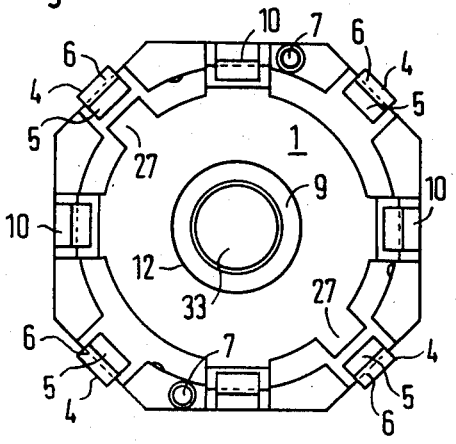
FIG. 5 shows the housing part as seen from below.
Figure 6:
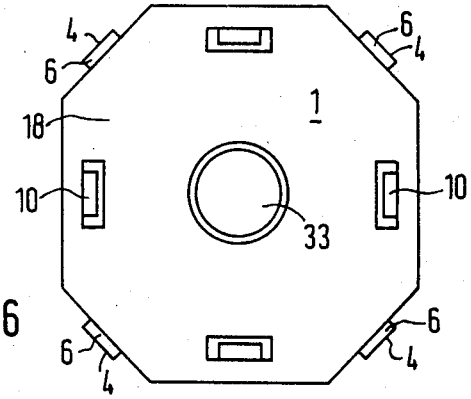
FIG. 6 shows the housing part as seen from above.
Figure 7:
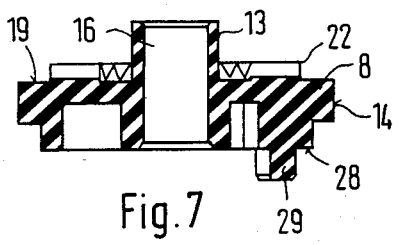
FIG. 7 shows the rotor in a sectional sideview.
Figure 10:
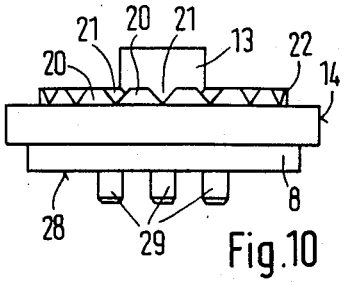
Figure 8:
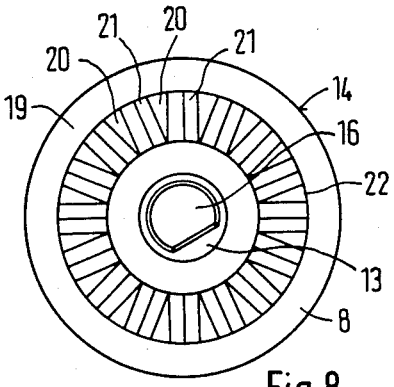
FIG. 8 shows the rotor as seen from above.
Figure 11:
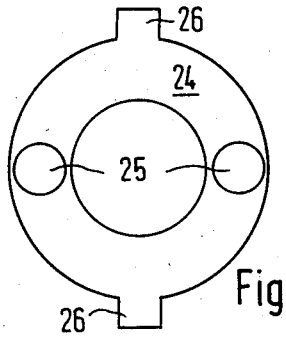
FIG. 11 shows the stop spring as seen from above.
Figure 12:
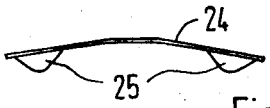
FIG. 12 shows the stop spring in a sideview.
Figure 9:
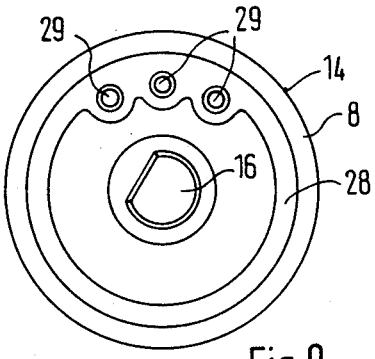
FIG. 9 shows the rotor as seen from below, FIG. 10 show the rotor in a sideview.
Figure 13:
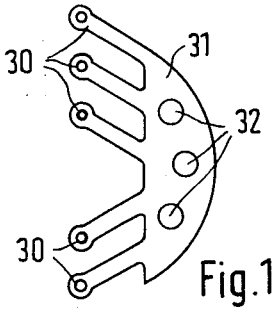
FIG. 13 shows one contact spring as seen from above.
Figure 14:
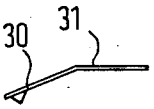
FIG. 14 shows the contact spring in a sideview.

The reference numeral 1 indicates a housing part or a housing for a rotary switch, in particular of a miniature rotary multi-position switch which, in the given example, is shown to have the shape of an open box. For inserting and fixing the same in a printed circuit board 2, it is provided on its open side 3 facing the board, with downwardly projecting extensions designed as plate members 4 having snap locks 5. These are capable of being inserted into corresponding recesses provided for in the printed circuit board, with the snap locks 5 moulded to the projecting ends 6, engaging behind the printed circuit board.

For fixing the housing part 1 exactly in position on the printed circuit board 2, one or more additional centering pins 7 are moulded, if so required, to the housing part 1, which are capable of engaging into centering openings in the printed circuit board 2.

A rotor 8 is pivoted to the housing part 1 in that it is inserted from the open side 3 against a limit stop 9 acting as a means for restricting the insertion depth, and is rotatably supported in the inserted position by means of resilient hooks acting as detent members 10. This is accomplished, for example, in that the spacing of the planes between the limit stop 9 and the surrounding face 11 of the detent members 10 is slightly greater than the thickness of the rotor 8.

The limit stop 9 is formed by the end face of a bearing bushing 12 of the housing part 1, in the opening 33 of which there is rotatably supported a centric shaft of the rotor 8 designed as a journal pin 13. An additional second axial, rotatable bearing can be formed by the jacketing surface 14 of the rotor 8 together with the inside 15 of the housing part 1.

Both the rotor 8 and the journal pin 13 are provided with a throughgoing bore 16 into which a rotating control shaft 17 can be inserted with a forced fit. The control shaft 17 can be pressed-in in such a way as to project either on the open side 3 or on the opposite closed side 18 provided with the bearing bore of the bearing bushing 12 of the housing part 1, or else on both sides 3, 18, thus permitting the control shaft 17 to be actuated optionally from one of the sides. It is then left at the discretion of the user as to how the printed circuit board is built into equipment, because the user, in any case, can attach the control shaft 17 in such a way as to be capable of being actuated from the desired side. The control shaft 17 can also be pressed into position by the manufacturer, or injection-moulded in the desired position, or else positioned in the course of manufacturing the rotor 8.

The inner surface 19 of the rotor 8 is provided with a stepping ring 22 consisting of elevations 20 and recesses 21. The elevated portions 20 and the recesses 21 are provided for in the contact spacing of the switching steps of the rotary switch. Between these recesses and elevations and the inside wall 23 on the closed side 18 of the housing part 1 there is provided a stop spring 24 preferably designed as an angular disk. This stop spring 24 is provided with at least one detent boss 25, such as a spherical impression, which is capable of lockingly engaging into a recess 21. In this way, the rotor 8 and the control shaft 17, is capable of being releasably locked in the individual switching stages.

The stop spring 24 is provided with at least one tongue 26 which, together with a groove 27 located in housing part 1 forms an interlocking anti-rotation means for the stop spring 24. An alternate preferred embodiment locates tongue 26 and groove 27 in housing 1 and spring 24, respectively.

As shown in one preferred embodiment, there are provided two such detent bosses 25 arranged opposite each other. Whether bosses 25 are arranged diametrically or nearly diametrically depends primarily on whether there are an even or an odd number of switch positions provided for.

Tongue 26 is arranged staggered substantially 90° in relation to the location of bosses.

On the side 28 of the rotor 8 facing printed circuit board 2*a* plurality of plugs 29 are moulded. A contact spring 31, which is provided with contact blades 30, is inserted through boreholes 32 onto plugs 29. By way of deformation, such as thermoplastic deformation in cases where the rotor 8 consists of a thermoplastic material, the contact spring 31 is fixed in its position.

The contact blades 30, when the rotary switch is inserted into the printed circuit board 2, come into contact with the individual circuits of the printed circuit board 2, designed to function as fixed contacts. It is seen, that depending on the arrangement and the number of contacts blades 30 and fixed contacts, various switching possibilities are provided for.

Appropriately, the housing part 1 is made from a resilient material, in particular from a plastics material. In this way both the plate members 4 and the detent members 10 may form one signal structural part therewith, and can be manufactured, for example, from a suitable plastics material by employing an injection-moulded process. Advantageously, each time two or more plate members 4 and detent members 10 are provided for alternately, so that the housing part together therewith can be manufactured by employing a simple, two-part injection mould.

The rotary switch according to the invention, therefore, has a compact construction consisting of only a few parts and, after having been inserted into a printed circuit board or any other suitable plate or panel, can be actuated from one of the two sides, or else from both sides vertically in relation to the direction of either the circuit board or the plate or panel.

What is claimed is:

1. A rotary switch for being mounted on a printed circuit board, said switch comprising:

a housing defining a throughgoing aperture;

a rotor with a centric shaft, said centric shaft defining a throughgoing aperture, said rotor is frictionally mounted in said housing; and a rotating control shaft being axially adjustably mounted in the centric shaft aperture, and said centric shaft aperture being sized to adjustably receive said control shaft, and said control shaft projecting through said housing aperture.

2. A rotary switch as in claim 1 further comprising extension means for attaching said switch to said printed circuit board, said extension means comprising plate members with ends to be inserted and projecting through apertures in said printed circuit board, said ends comprising locking means, said locking means, for snapping behind said printed circuit board.

3. A rotary switch as in claim 2, wherein said housing comprises an elastic material, with said extension means forming one structural unit with said housing part.

4. A rotary switch as in claim 3, wherein said housing further comprises the shape of a box open on one side, said open side facing said printed circuit board when said switch is attached to said printed circuit board.

5. A rotary switch as in claim 4, wherein said rotor is capable of being inserted from said open side into said housing part, said housing part comprising a limit stop for restricting the insertion depth of said rotor, said housing further comprising detent members for retaining said rotor within said housing part.

6. A rotary switch as in claim 5, wherein said rotor further comprises a stepping ring comprising elevations and recesses staggered in accordance with the contact spacing of switching steps, said switch further comprising a stop spring having at least one detent boss which is capable of lockingly engaging said recesses.

7. A rotary switch as in claim 6 wherein said stop spring comprises an annular disk, said stop spring and said housing further comprising at least one protruding tongue adapted to insertingly engage at least one groove.

8. A rotary switch as in claim 7, wherein said tongue is provided for in said stop spring.

9. A rotary switch as in claim 8, wherein said stop spring comprises two diametrically arranged detent bosses, said bosses being staggered by 90° with respect to the groove and tongue joint.

10. A rotary switch as claimed in claim 9 wherein said rotor, on its side associated with said printed circuit board, comprises several deformable plugs on which a contact spring with outwardly projecting contact blades is plugged and retained in position by deformation of said plugs.

11. A rotary switch as claimed in claim 10 wherein at least one centering pin directed towards said printed circuit board and capable of being inserted therein, is moulded to said housing part.

* * * * *